United States Patent [19]

Greiner et al.

[11] Patent Number: 4,698,924

[45] Date of Patent: Oct. 13, 1987

[54] GRIPPING STUDS FOR SPORTS SHOES

[75] Inventors: Peter Greiner, Wangen; Hubert Pflüger, Wetzisreute; Horst Widmann, Schwaig, all of Fed. Rep. of Germany

[73] Assignee: Adidas Sportschuhfabriken Adi Dassler Stiftung & Co. KG, Fed. Rep. of Germany

[21] Appl. No.: 887,186

[22] Filed: Jul. 21, 1986

[30] Foreign Application Priority Data

Jul. 27, 1985 [DE] Fed. Rep. of Germany ..... 3527009
Sep. 12, 1985 [DE] Fed. Rep. of Germany ..... 3532607

[51] Int. Cl.[4] ..... A43C 15/16; A43C 15/00
[52] U.S. Cl. ..... 36/134; 36/670
[58] Field of Search ..... 36/134, 67 R, 67 A, 36/128, 67 D, 59 R, 62, 67 B, 67 C, 61, 64, 66

[56] References Cited

U.S. PATENT DOCUMENTS

| | | | |
|---|---|---|---|
| 3,101,763 | 8/1963 | McGehee | 36/67 D |
| 3,766,670 | 10/1973 | Nakajima | 36/67 B |
| 3,925,529 | 12/1975 | Bermer et al. | 36/134 |
| 4,633,600 | 1/1987 | Dassler et al. | 36/134 |

FOREIGN PATENT DOCUMENTS

| | | | |
|---|---|---|---|
| 0163823 | 12/1985 | European Pat. Off. | 36/114 |
| 0171621 | 2/1986 | European Pat. Off. | 36/62 |
| 2313646 | 10/1974 | Fed. Rep. of Germany | 36/67 D |
| 3233900 | 3/1984 | Fed. Rep. of Germany . | |
| 2398471 | 3/1979 | France | 36/67 D |
| 2539595 | 7/1984 | France | 36/67 R |
| 0015077 | 1/1983 | Japan | 36/134 |
| 1277684 | 6/1972 | United Kingdom | 36/134 |
| 2098457 | 11/1982 | United Kingdom | 36/134 |

*Primary Examiner*—Werner H. Schroeder
*Assistant Examiner*—Steven N. Meyers

[57] ABSTRACT

A gripping stud for sports shoes comprises a stud body and a ceramic insert connected to the stud body thereby to form the ground-engaging surface thereof. The stud body comprises a central metal portion and a base portion disposed therearound while the ceramic insert connected to the lower end of the metal portion is of a flat lens-like configuration, with curved top and bottom sides. Alternatively the ceramic insert comprises a plurality of juxtaposed balls embedded in a stud body at the ground-engaging surface of the stud.

15 Claims, 5 Drawing Figures

GRIPPING STUDS FOR SPORTS SHOES

BACKGROUND OF THE INVENTION

The invention relates generally to sports shoes or boots and more particularly to a stud-shaped gripping element for such a shoe or boot. For the sake of simplicity herein, the term sports shoe will be used to denote any appropriate form of sports shoe, sports boot (being generally of a heavier construction than a sports shoe in the narrow sense), and the like. Further for the sake of simplicity herein the term gripping stud will be used in this specification to denote gripping elements which are used in particular on sports shoes for games played on a field or like surface and which are commonly referred to as studs or dogs. The invention is therefore not intended to cover gripping elements which are used on running shoes, in the form of spikes.

Many different forms of gripping studs for sports shoes have already been put forward, which comprise a stud body in combination with a ceramic insert which is connected to the stud body, for example by being secured to the lower end of a central metal portion thereof, and which forms the ground-engaging surface of the gripping stud. The ceramic inserts may comprise for example aluminium oxide, silicon carbide, tungsten carbide and the like, and the purpose thereof is substantially to increase the length of the service life of the gripping studs by making use of the very high level of resistance to wear of ceramic materials, while also avoiding the formation of sharp edges and nicks or notches on the gripping studs, which are produced due to wear thereof and which are a source of possible injury to players. Hitherto however it has not been possible for such gripping studs to be put to proper practical use because it has not been possible for the ceramic insert to sufficiently firmly connected to the body of the gripping stud, that the connection between the ceramic insert and the stud body is capable of securely withstanding the forces which act thereon in use of the sports shoe, while on the other hand it has not been possible to hold the manufacturing costs at a sufficiently low level that a ceramic-insert gripping stud is actually worthwhile, in comparison with gripping studs of the conventional configuration. Thus, in relation to a gripping stud as disclosed in German laid-open application (DE-OS) No. 32 33 900, an oxide ceramic insert which is of a frustoconical configuration at its top side is injected directly into the stud body which comprises plastic material, or is fixed in position thereon by adhesive means. Practical experience has shown however that that kind of connection between the ceramic inset and the stud body is not capable in the long term of withstanding in particular the thrust forces which act on the stud perpendicularly to the longitudinal axis thereof and which occur for example when the sports shoe on which the stud is fitted is subjected to a lateral loading on hard ground, so that the ceramic inserts come loose and may rapidly be lost. On the other hand, another form of stud element does not have specific ceramic insert but is made in its entirety from ceramic material. The ceramic stud is increased in width at its upper end, being the end which is towards the sole of the sports shoe on which the stud is fitted, so that the stud in that region forms a flange-like configuration which is embedded into a support member comprising glass fibre-reinforced or carbon fibre-reinforced polyamide and is thereby anchored to the sole of the sports shoe.

That design of gripping stud is so complicated and therefore expensive that the design in question cannot be considered for a gripping stud which is to be sold as a low-cost item.

In another form of gripping stud, the stud comprises a stud body having a central metal portion and a base portion which is disposed around the metal portion and which may comprise plastic material. A ceramic insert which forms the ground-engaging surface of the stud element is connected directly to the lower end of the metal portion, being the end which is away from the sole of the sports shoe to which the stud is fitted, with the connection between the ceramic insert and the metal portion being made by adhesive or soldering. A stud structure of that kind is disclosed for example in British patent specification No. 1 277 684. In that stud the ceramic insert is in the form of a ball which is fixed in a recess at the lower end of the metal portion of the stud body. Although that stud provides the advantage of a substantially enhanced level of resistance to abrasive wear, the ball configuration used for the ceramic insert is very sensitive to impact spot loadings due to the brittleness of the ceramic material so that it has a pronounced tendency for pieces of ceramic material to splinter or break away from the stud when the person wearing the sports shoe having the stud walks on a hard surface such as concrete.

SUMMARY OF THE INVENTION

An object of the present invention is to provide a gripping stud which can be produced in a simple and inexpensive manner while however giving enhanced integrity even in relation to impact loadings.

Another object of the present invention is to provide a gripping stud for sports shoes and boots, of a composite structure adapted to optimum conditions of use while however affording an enhanced safety factor from the point of view of injury to players.

Yet another object of the present invention is to provide a stud for sports shoes, which enjoys a long service life while also substantially reducing the likelihood of the stud member wearing in such a way as to be capable of causing serious injury.

In accordance with the principles of the present invention, these and other objects are attained by a gripping stud for a sports shoe, comprising a stud body having a central metal portion and a base portion which is disposed around the metal portion. The stud further comprises a ceramic insert which forms the ground-engaging surface of the stud and which is connected to the lower end of the metal portion of the stud by adhesive or soldering means. The ceramic insert is lens-shaped in cross-section, with curved top and bottom sides.

In another form of the gripping stud for sports shoes, in accordance with the principles of the present invention, the gripping stud comprises a stud body and a ceramic insert means which at least partially forms the ground-engaging surface of the gripping stud and which comprises a plurality of individual ceramic bodies arranged in closely side-by-side relationship and embedded in the gripping stud body.

The invention thus provides two aspects, the first thereof providing that the ceramic insert which is secured directly to the underside of the metal portion encased in the stud body, by adhesive or soldering means, is of a lens-shaped configuration with curved top and bottom surfaces, with the ratio of its diameter to its thickness preferably being about 2:1. In addition, the ceramic insert preferably has a peripheral surface which is in the form of a cylindrical surface. It has been found that that configuration for the ceramic insert makes it possible to achieve maximum strength in relation to the combined and complex loadings which occur on the stud in use of the sports shoe to which the gripping stud is fitted. It will be appreciated that, in the manufacture of ceramic components, when they cool down, internal stresses are generated which result in a considerable degree of brittleness of the ceramic material, so that consequently the ceramic material is sensitive to impact or shock loadings. The lens-shaped configuration of the ceramic insert of the stud according to the present invention means that the stresses in the ceramic material and thus the sensitivity thereof to impact or shock loadings can be minimised to such an extent that the ceramic inserts on the gripping studs are capable of withstanding impact against for example a concrete surface or floor. That aspect therefore opens the way for the gripping stud according to the present invention to be successfully used in practical situations.

The fact that the ceramic insert is directly connected by adhesive or soldering to the metal portion of the stud gives such a level of strength that a face-to-face connection between the ceramic insert and the metal portion is adequate, without the need for the ceramic insert to engage positively into the metal portion, that is to say, there is no need for interengaging means on the ceramic insert and the metal portion, to provide for positive interconnection and location therebetween. An important consideration is that the adhesive connection still has a certain degree of elastic flexibility when the adhesive has set or hardened. Elastic flexibility in the connection can be achieved in that way for example by using epoxy resin adhesives. When the ceramic insert is secured in position by a soldering operation, the sensitivity of ceramic materials to thermal shock means that it may be desirable for the ceramic insert firstly to be metallised at the surface with which it is to be connected to the metal portion of the gripping stud, with the solder connection then being made by a solder which has a low melting point.

There are various possible configurations for the central metal portion, as a part of the body of the gripping stud. At any event however it is desirable for the lower end of the metal portion, that is to say, the end which in use of the stud faces towards the ground, to be provided with a plate portion to which the ceramic insert is then connected. The shape of the downwardly facing surface of the plate portion is matched to the curved top side of the lensshaped ceramic insert, and is therefore of a concavely curved configuration. The plate portion is desirably of such a size that it covers at least the major part of the top side of the ceramic insert. At its upper end, the central metal portion of the body of the stud is desirably provided with a screwthread when the gripping stud is to be screwed into a screw-threaded mounting in the sole of a sports shoe, or alternatively the central metal portion of the body of the stud may be provided with a plate which is adapted to be directly embedded and anchored in the sole of the sports shoe when the gripping stud is in the form of a stud or dog which is provided in one piece with the sole of the shoe. As the loadings which occur in use of the sports shoe are primarily carried by the base portion of the gripping stud, the purpose of the central metal portion of the gripping stud is essentially that of connecting the ceramic insert to the body of the stud. The metal portion may therefore be of a light and neat design. Thus, particularly when the central metal portion carries a screwthread for fixing the stud to the sole of a shoe, the metal portion is desirably in the form of a shaft or stem. When the gripping stud is in the form of a stud which is produced in one piece with the sole of the shoe however, the metal portion may also be a spring, preferably a coil spring. Secured to the respective ends of the coil spring are plate portions which serve for connecting the spring to the ceramic insert at one end and for anchoring the spring in the sole of the shoe, at the other end. In that form, the metal portion of the gripping stud does not reduce the high degree of flexibility which is desired in gripping studs, but it acts as a spring which is disposal parallel to the base portion of the gripping stud.

In the further aspect of the teaching of the present invention as set forth above, the gripping stud has ceramic insert means embedded in the body of the gripping stud and formed by a plurality of ceramic bodies arranged in closely side-by-side relationship. The ceramic bodies are preferably of a spherical shape. The fact that the gripping stud comprises a multiplicity of separate ceramic bodies, for example up to ten thereof, means that the respective contact and embedding area in the body of the gripping stud is considerably increased so that the holding forces of the ceramic insert means are correspondingly also increased as a result of that arrangement. Therefore, the relationship of the loading which acts on each individual ceramic body in the stud, in relation to the holding force which is available to retain it in the stud, is thus better than when the stud has a single one-piece ceramic insert. Consequently, it is possible in a simple manner to achieve a considerable increase in the service life of the stud, in spite of the ceramic bodies being directly embedded in the body of the gripping stud by the material of the body of the stud being cast or moulded around the ceramic bodies.

Further objects, features and advantages of the teaching of the present invention will becomes more clearly apparent from the following description of preferred embodiments thereof.

DESCRIPTION OF THE PREFERRED EMBODIMENTS

Figure 1:
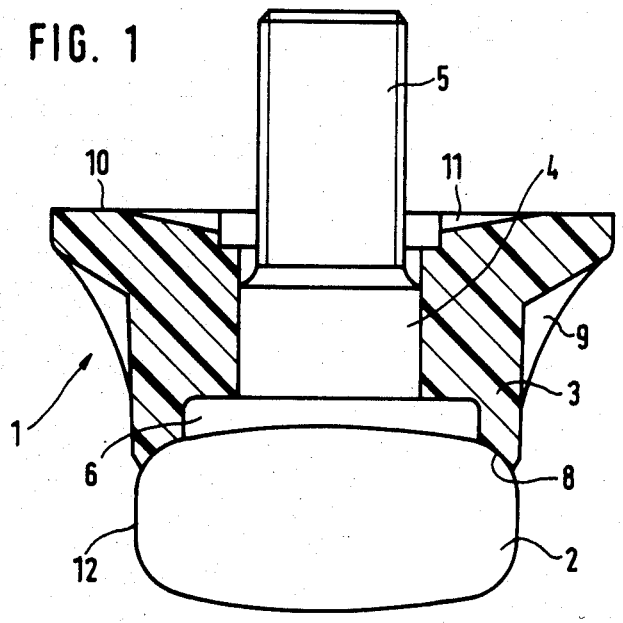
FIG. 1 is a view in longitudinal section through a gripping stud according to the invention, in the form of a separate screw-in stud.

Referring to the drawings generally, it will be noted that the gripping studs shown on an enlarged scale therein are all rotationally symmetrical in regard to their essential parts and in regard to their overall configuration, so that there is no need to show an end view of the studs. However it should further be appreciated that a rotationally symmetical stud configuration is not necessarily employed, in accordance with the principles of the present invention, but that other configurations may also be used, for example an oval stud configuration.

Referring now firstly to FIG. 1, the screw-in gripping stud shown therein comprises a gripping stud body which is generally indicated by reference numeral 1, and a ceramic insert 2 which is disposed at the lower end of the gripping study body 1, namely the end which in the normal position of use of the gripping stud on the sole of a shoe, faces downwardly towards the ground. The body 1 of the gripping stud is in turn made up of a base portion 3 and a central metal portion 4 in the form of a stem or shaft which carries a screwthread 5 at its upper end portion. Formed integrally on the lower end of the shaft 4 is a plate portion 6 which projects flange-like beyond the shaft 4 and which is also curved at its underside, thereby to adapt it to the curved top side of the ceramic insert 2. In the illustrated embodiment, the diameter of the plate portion 6 is about 76% of the diameter of the ceramic insert 2.

The base portion 3 is a separately produced portion of plastic, rubber, aluminium or the like, which can be fitted on to the central metal shaft 4 and which is a close fit around the metal shaft 4 and the plate portion 6. In addition, as can be clearly seen from FIG. 1, the base portion 3 bears against the ceramic insert 2 by means of an annular surface 8 which is of a generally conical configuration or which is preferably even adapted to the rounded configuration of the ceramic insert 2 at that location. On its outside surface, the base portion 3 has the usual notches or slots 9 to provide surfaces for engagement of a screwing tool or key. On its end face 10 which is towards the outside surface of the sole (not shown) of the sports shoe, the base portion 3 further has the usual surface configuration such as a fan-disc configuration, as indicated at 11, in order to promote the grip of the base portion 3 against the surface of the sole, to prevent the stud from being accidentally turned in its mounting. As can be seen from FIG. 1, the surface 10 of the base portion 3 of the gripping stud is increased in width, in relation to the lower part of the base portion 3.

The ceramic insert 2 is of a lens-like configuration in crosssection, with curved top and bottom sides, and comprises for example aluminium oxide ($Al_2O_3$), silicon carbide (SiC) or steatite It is thus of the rotationally symmetrical lens shape shown in the drawings, the ratio of its diameter to its thickness preferably being about 2:1 and even more preferably about 2.1:1. The volume of the ceramic insert 2, for a practical design of the gripping stud as shown in FIG. 1, is about 0.3 cm. As already indicated above, that configuration and volume of the ceramic insert provides maximum strength thereof relative to the loadings which occur in use of the gripping stud.

The peripheral surface 12 of the ceramic insert is cylindrical over approximately half the thickness of the insert, and blends or merges into the curved top and bottom sides respectively by rounded transitional portions, without sharp edges thereat.

The ceramic insert 2 is fixed to the suitably adapted co-operating surface of the plate portion 6 by means of an epoxy resin adhesive which still has a slight degree of elasticity in the hardened condition, or by means of a soldering operation. There is no connection between the conical or part-toric annular surface 8 of the base portion 3, and the ceramic insert 2; on the contrary, the ceramic insert simply bears against the surface 8.

The metal shaft 4 and the associated opening in the base portion 3 of the gripping stud are of a square configuration so that the metal shaft 4 can be turned and screwed into its mounting on the sole of a shoe, by rotating the base portion 3. It is also desirable for the metal shaft 4 to be of a polygonal configuration in cross-section, even when the base portion 3 of the gripping stud is fixedly connected to the metal shaft 4, for example by direct injection moulding or casting thereof. Making the base portion 3 in the form of a separate member has the advantage that the overall length of the gripping stud may be varied by replacing a given base portion 3, by a different base portion of greater or smaller length.

Figure 2:
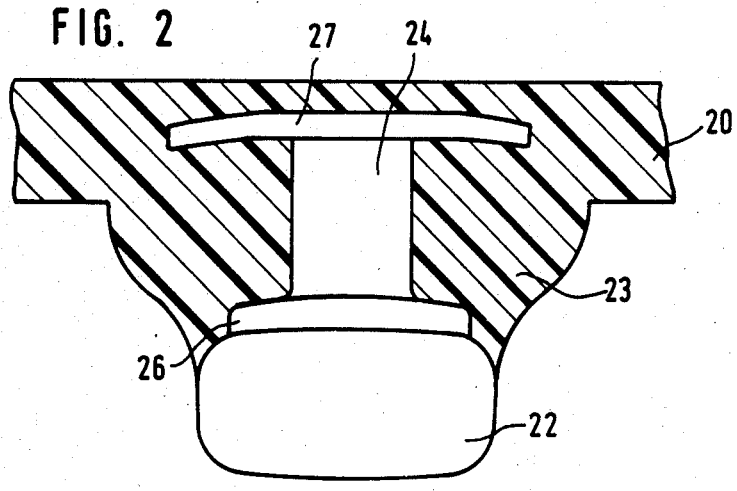
FIG. 2 is a view corresponding to the shown in FIG. 1 through a gripping stud according to the invention, in the form of a stud which is mounded on the sole of a sports shoe.

Reference will now be made to FIG. 2 showing a moulded stud which is thus integrally connected to the sole 20 of a sports shoe, with the sole 20 comprising for example an elastomeric polyurethane. The gripping stud once again comprises a base portion 23 which is formed in one piece with the sole 20, and a central metal portion 24 in the form of a stem or shaft; the shaft 24 carries a plate portion 26 at the lower end thereof, and an embedding plate portion 27 disposed at the upper end of the shaft 24. The ceramic insert 22 is in principle of the same configuration as the ceramic insert 2 shown in FIG. 1, with the ratio of its diameter to its thickness being about 2:1 in this case. In this construction also the ceramic insert 22 is connected to the underside of the plate portion 26 by glueing using an epoxy resin adhesive, or by soldering.

The stud configuration shown in FIG. 2 is produced in the following manner: the metal shaft 24 and the ceramic insert 22 are connected together to form a fixed unit which is then introduced into the casting mould for producing the sole 20. The plastic material for the sole 20 is then introduced or injected into the mould and is thus injection-moulded or cast around the unit 22, 24, which is possibly also vulcanised therein. By virtue of that mode of operation, the metal shaft 24 with the plate portions 26 and 27 and the upper part of the ceramic insert 22 which is clearly visible in FIG. 2, are fixedly embedded in the plastic material making up the sole 20 and the base portion 23 of the gripping stud.

Figure 3:
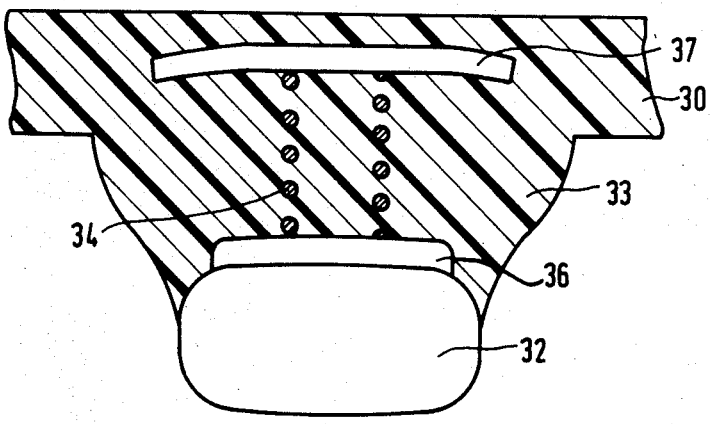
FIG. 3 is a view in longitudinal section through a modified embodiment of the moulded stud.

Referring now to FIG. 3, shown therein is a modification of the stud configuration illustrated in FIG. 2, in that instead of the solid metal shaft 24, the FIG. 3 stud has a coil spring 34. Secured to one end of the spring 34 is a plate portion 36 which serves for fixing the ceramic insert 32 in position, while connected to the other end of the spring 34 is an anchoring plate portion 36 for embedding in the material forming the sole 30 of the shoe and the base portion 33 of the stud configuration. The plate portions 36 and 37 are connected to the spring 34, for example by welding. It will be appreciated that the plate portion 36 again comprises metal while the anchoring plate 37 may also be made from another material. The ceramic insert 32 is connected to the plate portion 36 in the same manner as described above with reference to FIG. 2.

In manufacture of the stud configuration shown in FIG. 3, the ceramic insert 32, the spring 34 and the plate portions 36 and 37 are joined together to form a fixedly connected unit which is then put into a casting mould for the sole 30. The material for forming the sole 30 is then introduced or injected into the mould and is thus moulded or cast around the unit 32, 34, 36 and 37. When the material is introduced into the mould, in a fluid condition, the material penetrates into the interior of the spring 34 as it forms the base portion 33, so that the material of the sole 30 and the base portion 33 entirely encloses the turns or coils of the spring 34. That causes the flexibility of the stud in a vertical or axial direction thereof to be reduced considerably less than in the case of the stud shown in FIG. 2, so that the elastic properties of the FIG. 3 stud practically correspond to those of a stud which consists only of the plastic material from which the sole 30 is also made.

Figure 4:
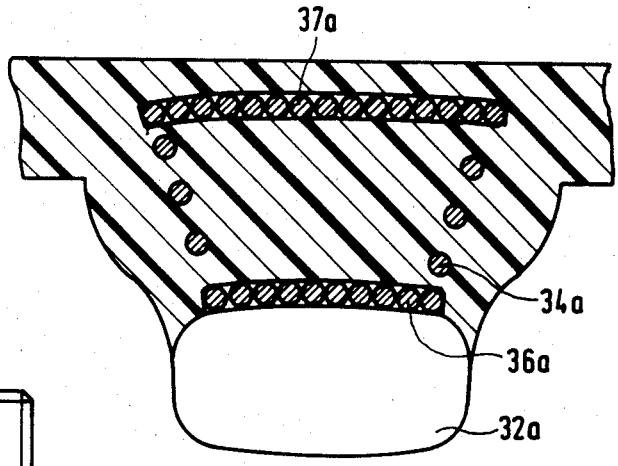
FIG. 4 is a view in longitudinal section through a further modified embodiment of a moulded stud.

Reference will now be made to FIG. 4 showing a stud configuration which is in principle of the same construction as the embodiment shown in FIG. 3. However the stud of FIG. 4 differs from the stud of FIG. 3 in regard to the nature and the arrangement of the spring 34*a* which in this embodiment is a conical or tapering cast steel spring with clossoed ends to its turns. By virtue of the ends of the spring being closed in the manner illustrated in FIG. 4, there is no need to provide the fixing plate portion 36 and the anchoring plate portion 37 used in the FIG. 3 embodiment. The plastic material which forms the sole of the shoe in FIG. 4 flows around the closed end 37*a* of the spring 34*a*, at the upper end thereof, thus giving adequate spring fixing. Because the closed end 37*a* of the spring is not a continuously stiff plate portion, it is better able to follow the bending movements of the sole. The lower end 36*a* of the spring affords a sufficient metal surface for direct connection to the ceramic insert 32*a*, in the same manner as described above with reference to FIGS. 1 through 3.

Figure 5:
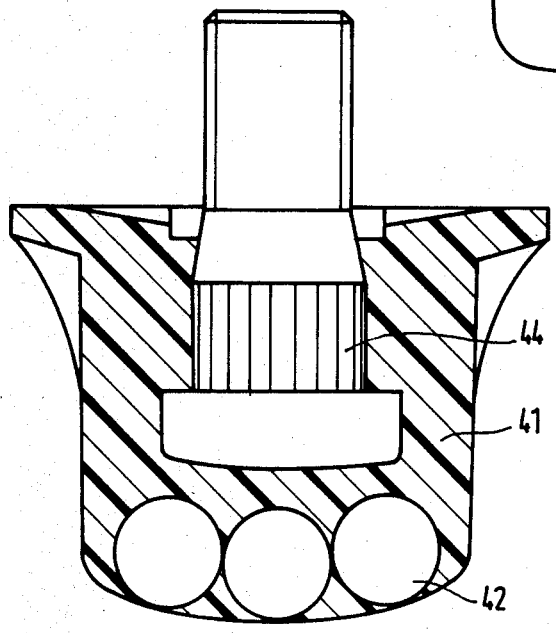
FIG. 5 is a view in longitudinal section through a screw-in stud with a modified form of ceramic insert.

Reference will now be made to FIG. 5 showing a gripping stud in accordance with a modified embodiment of the teachings of the present invention. The stud illustrated in FIG. 5 comprises a gripping stud body 41, with a screw member 44 which is directly embedded in the body 41, for example by virtue of the body 41 being cast or injection-moulded around the screw member 44. The screw member 44 may possibly be provided with knurling, serrations or like surface profiling, in order to provide a firm connection between the body 41 of the stud and the screw member 44.

At its lower end in FIG. 5, being the end which is away from the sole of the shoe to which the stud is fitted, the screw member 44 has an enlarged portion defining a flange or collar-like part of the screw member. Adjacent the ground-engaging surface of the body 41, a plurality of ceramic inserts in the form of balls 42 are directly embedded in the body 41. The balls 42 are arranged in closely side-by-side relationship, and in fact are in contact with each other. With their underside, the ceramic balls 42 extend as far as the ground-engaging surface of the gripping stud.

The size of the ceramic balls 42 is such that the illustrated embodiment has for example eight ceramic balls 42. After just a very small amount of wear of the plastic material forming the body 41, the ceramic balls 42 will form the ground-engaging surface of the gripping stud, with their downwardly facing surfaces.

Instead of the ball shape, the gripping stud may also have insert means in the form of ceramic bodies 42 which are of a different configuration, being for example of a cube shape. However, the ball shape has been found to be advantageous because it does not provide any edges at which substantial forces could be built up, in the event of the gripping stud being subjected to a lateral loading.

The material used for the metal portion of the gripping stud in each of the embodiments may be any suitable material but the preferred material comprises steel or aluminium.

It will be appreciated that the above-described embodiments have been set forth only by way of example of the teachings of the present invention and that various modifications and alterations may be made therein without thereby departing from the spirit and scope of the invention.

What is claimed is:

1. A gripping stud for a sports shoe, including a stud body comprising an at least substantially central metal portion and a base portion around the metal portion, and a ceramic insert which is substantially lens-shaped with convexly curved top and bottom surfaces and which is connected to the lower end of the metal portion, thereby to provide a ground-engaging surface of the gripping stud.

2. A stud as set forth in claim 1 wherein said ceramic insert is connected to said metal portion in face-to-face contact therewith.

3. A stud as set forth in claim 1 wherein said ceramic insert is connected to said metal portion by adhesive means.

4. A stud as set forth in claim 1 wherein said ceramic insert is connected to said metal portion by solder means.

5. A stud as set forth in claim 1 wherein the ratio of the diameter of the ceramic insert to the thickness of the ceramic insert in the center thereof is about 2:1.

6. A stud as set forth in claim 5 wherein said ceramic insert has a cylindrical peripheral surface.

7. A stud as set forth in claim 1 wherein said ceramic insert has rounded transitions between the top and bottom surfaces of the ceramic insert and the peripheral surface thereof.

8. A stud as set forth in claim 1 wherein said metal portion is provided at its lower end with a plate portion which provides a contact surface to which said ceramic insert is connected, said contact surface being adapted to the shape of the co-operating top surface of said ceramic insert.

9. A stud as set forth in claim 1 wherein said metal portion has a screwthread adapted to be screwed into a screwthreaded insert in a sports shoe sole.

10. A stud as set forth in claim 1 wherein said metal portion has a plate portion for direct embedding and anchoring in a sports shoe sole.

11. A stud as set forth in claim 1 wherein said metal portion is in the form of a shaft portion.

12. A stud as set forth in claim 1 wherein said metal portion is in the form of a spring.

13. A stud as set forth in claim 1 wherein said base portion is a separately produced portion adapted to be fitted on to said metal portion and non-rotatably connected thereto.

14. A gripping stud for a sports shoe, including a stud body and ceramic insert means adapted to provide at least part of a ground-engaging surface of the stud, said ceramic insert means comprising a plurality of individual ceramic bodies embedded in said stud body in close side-by-side relationship therein.

15. A stud as set forth in claim 14 wherein said ceramic bodies are each of at least substantially spherical shape.

* * * * *